US011317715B2

(12) United States Patent
Long

(10) Patent No.: US 11,317,715 B2
(45) Date of Patent: May 3, 2022

(54) INTEGRATED INCLINABLE GOODS SHELF

(71) Applicant: Lonman Auto Accessories Co., Ltd, Dongguan (CN)

(72) Inventor: Shihu Long, Dongguan (CN)

( * ) Notice: Subject to any disclaimer, the term of this patent is extended or adjusted under 35 U.S.C. 154(b) by 99 days.

(21) Appl. No.: 16/874,682

(22) Filed: May 15, 2020

(65) Prior Publication Data

US 2021/0353054 A1 Nov. 18, 2021

(51) Int. Cl.

| | |
|---|---|
| ***A47B 57/04*** | (2006.01) |
| ***A47B 96/02*** | (2006.01) |
| *A47B 46/00* | (2006.01) |
| *A47B 88/48* | (2017.01) |

(52) U.S. Cl.

CPC ..... *A47B 57/04* (2013.01); *A47B 96/025* (2013.01); *A47B 46/005* (2013.01); *A47B 88/48* (2017.01)

(58) Field of Classification Search

CPC ..... A47B 57/04; A47B 88/48; A47B 96/025
USPC ..... 312/334.7, 313, 324
See application file for complete search history.

(56) References Cited

U.S. PATENT DOCUMENTS

| | | | | |
|---|---|---|---|---|
| 4,285,556 A * | 8/1981 | Loeffel | B25H 3/023 | 312/244 |
| 4,382,641 A * | 5/1983 | Abel | A47B 29/00 | 112/217.1 |
| 5,934,615 A * | 8/1999 | Treichler | B64D 11/003 | 244/118.5 |
| 6,442,030 B1 * | 8/2002 | Mammoser | G06F 1/1601 | 248/917 |
| 7,375,959 B2 * | 5/2008 | Chang | G06F 1/184 | 312/223.2 |
| 8,136,897 B2 * | 3/2012 | Mascari | A47B 46/005 | 312/242 |
| 2008/0085094 A1 * | 4/2008 | Krampotich | G02B 6/4455 | 385/135 |
| 2016/0088933 A1 * | 3/2016 | Rossignol | A47B 88/60 | 312/270.2 |

FOREIGN PATENT DOCUMENTS

| | | |
|---|---|---|
| CN | 206465870 U | 9/2017 |

* cited by examiner

*Primary Examiner* — James O Hansen

(57) ABSTRACT

An integrated inclinable goods shelf includes a housing having an opening on the front side, an inner frame assembly, and a tray assembly for bearing goods. The inner frame assembly is lapped on a bottom surface of the housing. The housing includes two outer side plates. The inner frame assembly includes two inner side plates respectively disposed between the corresponding outer side plates and the tray assembly. The front end of the outer side plate is hingedly connected to the front end of the corresponding inner side plate. The inner frame assembly is rotatable relative to the housing. The inner side plates are connected to the tray assembly via a slide assembly. The tray assembly is movable relative to the inner frame assembly.

9 Claims, 6 Drawing Sheets

INTEGRATED INCLINABLE GOODS SHELF

TECHNICAL FIELD

The present invention relates to the technical field of vehicle articles, in particular to an integrated inclinable goods shelf.

BACKGROUND

With the improvement of living standards of people, the travel frequency of people is getting higher and higher. In order to improve the quality of travel life, especially driving travel, people take living food in a vehicle, such that people can go to a further place to explore. The shelf life of the living food is limited. In order to take more food with a longer shelf life, various vehicle-mounted refrigerators are on sale on the market at present. However, when a vehicle-mounted refrigerator is loaded, a fixing frame is generally disposed in the vehicle for fixing, and the refrigerator needs to be transported into the vehicle during mounting. The applicant applied earlier a patent application No. CN201621398048.3 and entitled by "Multi-functional Vehicle-mounted Refrigerator Frame". However, the refrigerator frame only has a horizontal telescopic structure; and when s refrigerator needs to be transported, the refrigerator needs to be lifted to the height of a carriage, which is inconvenient for transportation.

SUMMARY In order to overcome the defects and deficiencies in the prior art, the objective of the present invention is to provide an integrated inclinable goods shelf; the goods shelf is inclinable a support frame, and reduce transportation height, so as to facilitate refrigerator transportation.

An integrated inclinable goods shelf, comprising a housing having an opening on the front side, an inner frame assembly, and a tray assembly for bearing goods, wherein the inner frame assembly is lapped on a bottom surface of the housing; the housing comprises two outer side plates; the inner frame assembly comprises two inner side plates; the inner side plates are respectively disposed between the corresponding outer side plates and the tray assembly; the front end of the outer side plate is hingedly connected to the front end of the corresponding inner side plate; the inner frame assembly is rotatable relative to the housing; the inner side plates are connected to the tray assembly via a slide assembly; and the tray assembly is movable relative to the inner frame assembly.

Further, a plurality of inner transverse plates are disposed between the two inner side plates.

Further, the lower end of the outer side plate extends forward or is connected to an outer bump; the inner side plate is connected to an inner bump extending forward; and a front connecting shaft is connected between the inner bump and the outer bump.

Further, the middle part of the inner side plate extends upward to form a connecting sheet; the front middle part of the outer side plate is connected to a mounting sheet; an air spring is disposed between the mounting sheet and the connecting sheet; and the two ends of the air spring are respectively pivotally connected to the mounting sheet and the connecting sheet.

Further, the rear end of the inner side plate extends upward to form a pressing sheet; and an inclined upper limit sheet is disposed at the upper end of the outer side plate. Preferably, the limit sheet is connected to a flexible stopper.

Preferably, the pressing sheet is provided with a limit hole in the middle; the middle part of the upper limit sheet is connected to a limit bar; and when the inner frame assembly inclines until the pressing sheet presses against the upper limit sheet, the middle part of the limit bar is located in the limit hole.

Preferably, one of the inner side plates is connected to a side lock assembly; the side lock assembly comprises a slide lock bar, an intermediate limit sheet, a transmission bar, a spring and a lock block, wherein the lock block is configured in a U-shape, and is fixed on one side of the pressing sheet; an extension block is disposed at the lower end of the lock block; the lower end of the side lock bar is hingedly connected to the inner side plate; the middle part of the side lock bar and the extension block are respectively hingedly connected to the two ends of the transmission bar; the intermediate limit sheet is fixed at the inner side plate; the transmission bar is provided with an annular fastening groove in the middle, and is connected to a reset sheet; the intermediate limit sheet comprises at least one limit sheet; the limit sheet is provided with a through hole in the middle; the transmission bar penetrates through the through hole; the transmission bar is sleeved on the spring; and the spring is located between the reset sheet and the limit sheet.

Further, the housing is provided with a plurality of bottom transverse plates at the bottom; the two ends of the bottom transverse plates are respectively connected to the lower ends of two outer side plates; the bottom transverse plate in frontmost is a front bottom plate; the front bottom plate is connected to a front lock assembly; the front lock assembly comprises an arc-shaped lock sheet; the rear end of the lock sheet is hingedly connected to the front bottom plate; the front end of the lock sheet extends out of the front bottom plate; the front end of the tray assembly extends downward to form a limit post; and the lower end of the limit post is located in an inner space of the lock sheet.

Preferably, the front bottom plate is connected to an elastic unit for pushing the middle part of the lock sheet to approach the limit post; after the provision of the elastic unit, the situation that the tray assembly may move out due to the deviation of the lock sheet from the movement track of the limit post at ordinary times can be avoided.

Further, the elastic unit comprises a rotary sheet and a reset spring; the rotary sheet is hingedly connected to the front bottom plate; one end of the rotary sheet presses against the rear end of the lock sheet; the front bottom plate is provided with a pressing head; the reset spring is located between the pressing head and the other end of the rotary sheet; the reset spring pushes the rotary sheet to rotate; and one end of the rotary sheet pushes the lock sheet to rotate to approach the limit post.

Further, the slide assembly comprises a linear slide rail.

Further, the tray assembly comprises a tray; the slide assembly is disposed on the two sides of the tray; an inner lock plate is disposed at the front end of the tray; the tray is provided with a mounting groove; a connecting hole is disposed at the lower end of the inner lock plate; and the connecting hole is connected to the mounting groove via a connector.

Further, a front stopper is disposed at the rear end of the front bottom plate; the front stopper is connected to a buffer; and the tray is provided with a blocking sheet matched with the front stopper.

The present invention has the following beneficial effects: in the present invention, the inner frame assembly is hingedly connected to the housing, and the inner frame assembly is slidably connected to the tray assembly, such that the tray can slide out of the housing in an inclined state, thus facilitating the transportation of the goods transportation.

REFERENCE SIGNS

Figure 1:
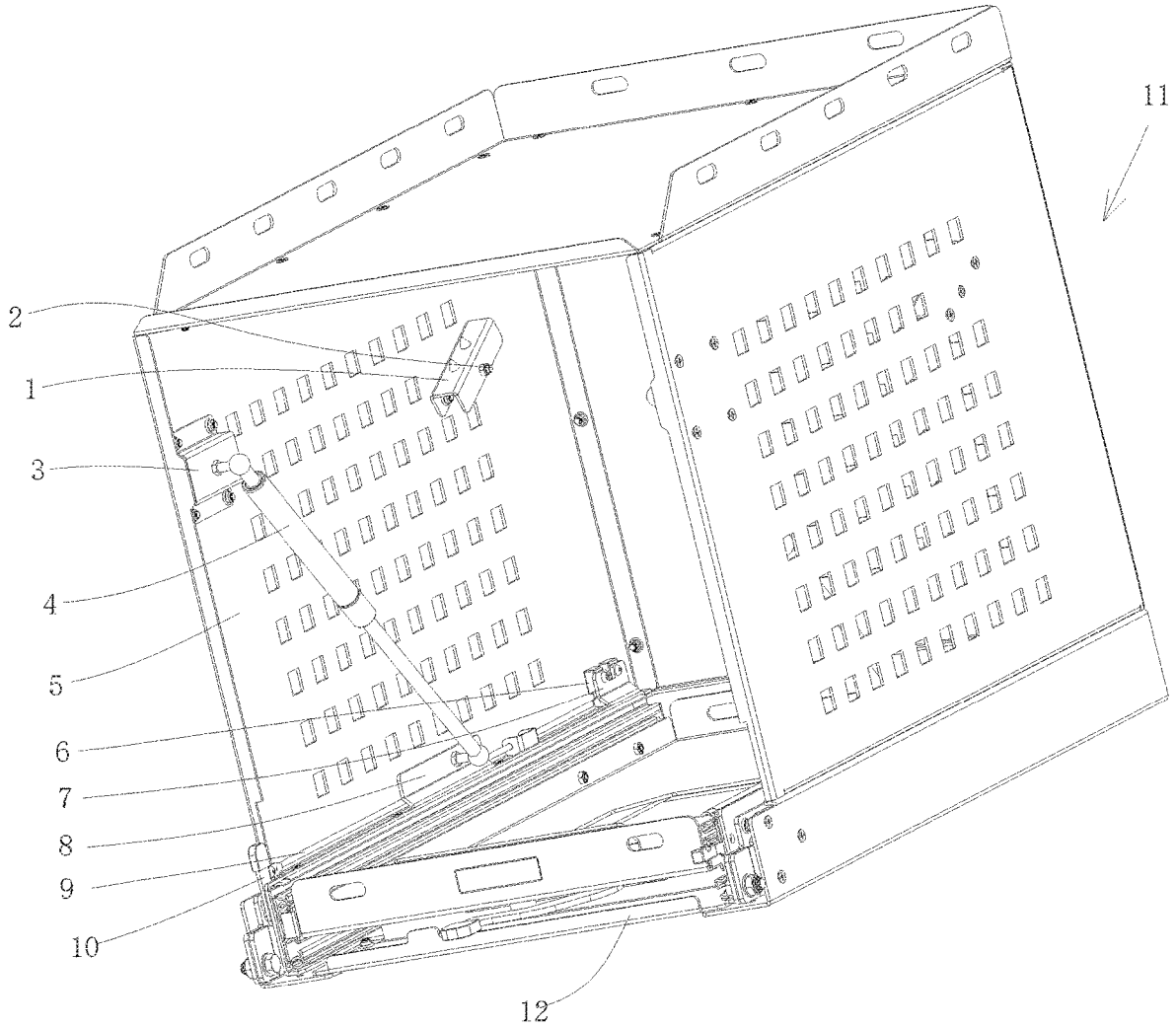
FIG. 1 is a structural schematic view of the present invention.

1, upper limit sheet; 2, limit bar; 3, mounting sheet; 4, air spring; 5, outer side plate; 6, lock block; 7, pressing sheet; 8, connecting sheet; 9, transmission bar; 10, side lock bar; 11, housing; 12, front bottom plate; 13, outer bump; 14, reset spring; 15, rotary sheet; 16, lock sheet; 17, buffer; 18, front stopper; 19, bottom transverse plate; 20, inner frame assembly; 21, reset sheet; 22, spring; 23, limit sheet; 24, inner side plate; 25, tray; 26, inner bump; 27, front connecting shaft; 28, inner lock plate; 29, intermediate limit sheet; 30, blocking sheet; 31, limit post; 32, inner transverse plate; 33, linear slide rail; 34, mounting groove; 35, tray assembly.

DETAILED DESCRIPTION

To facilitate the understanding of a person skilled in the art, the present invention will be further described hereafter in combination with embodiments and FIGS. 1-6. The content mentioned in the embodiments is not intended to limit the present invention.

An integrated inclinable goods shelf, comprising a housing 11 having an opening on the front side, an inner frame assembly 20, and a tray assembly 35 for bearing goods, wherein the inner frame assembly 20 is lapped on a bottom surface of the housing 11; the housing 11 comprises two outer side plates 5; the inner frame assembly 20 comprises two inner side plates 24; the inner side plates 24 are respectively disposed between the corresponding outer side plates 5 and the tray assembly 35; the front end of the outer side plate 5 is hingedly connected to the front end of the corresponding inner side plate 24; the inner frame assembly 20 can relatively rotate; the inner side plates 24 are connected to the tray assembly 35 via a slide assembly; and the tray assembly 35 is movable relative to the inner side plates 24.

Figure 6:
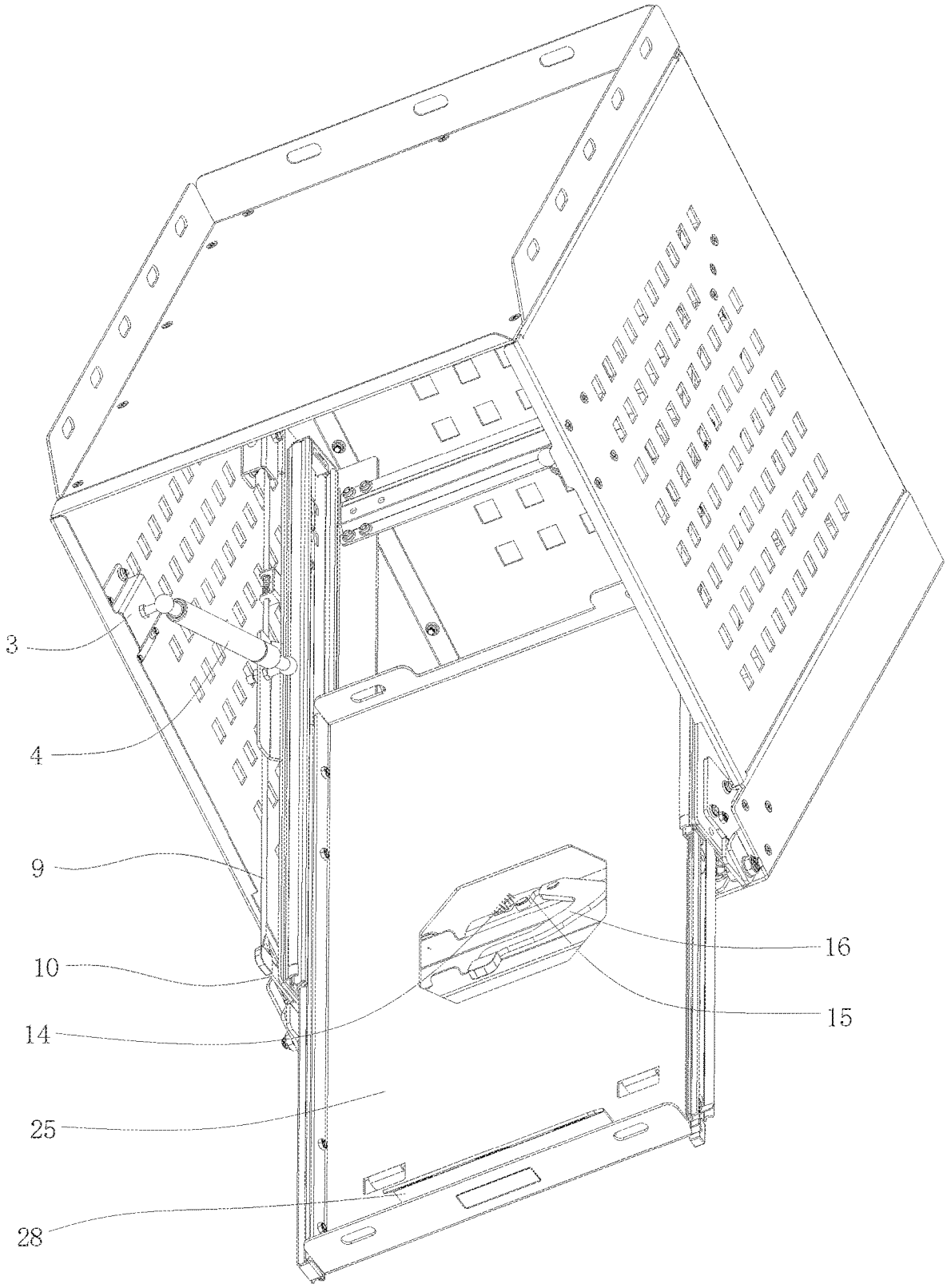
FIG. 6 is a structural schematic view of the expanded FIG. 1.

In the technical solution, the inner frame assembly 20 and the housing 11 is rotatable relatively; when in use, first, the tray assembly 35 moves outward relative to the inner frame assembly 20, such that most of the tray assembly 35 leaves; then, the inner frame assembly 20 and the tray assembly 35 rotate relative to the housing 11; the front end of the tray assembly 35 inclines downward, and is located at a lower position; with reference to FIG. 6, goods or a refrigerator are/is transported to the tray assembly 35; then, the tray assembly 35 is gradually overturned and reset, such that the goods or the refrigerator can retain steady; and finally, the tray assembly 35 is gradually pushed in the housing 11 to complete the placing of the goods or the refrigerator. The goods shelf is simple and convenient, and facilitates operation. The housing 11 plays a protection role in the goods inside; secondly, in order to improve the effect of the housing 11, a flanged edge is disposed on the upper side of the housing 11; by configuring the flanged edge, the housing 11 can stack articles, and can prevent the articles from sliding out, thus improving the effect thereof.

Further, a plurality of inner transverse plates 32 are disposed between the two inner side plates 24.

The inner transverse plates 32 are configured to support the tray assembly 35 and the goods or the refrigerator; preferably, the lower end of the inner side plate 24 bends inwards to form an L-shaped plate; and the two ends of the inner transverse plates 32 are respectively connected to horizontal sections of the L-shaped plate.

Further, the lower end of the outer side plate 5 extends forward or is connected to an outer bump 13; the inner side plate 24 is connected to an inner bump 26 extending forward; and a front connecting shaft 27 is connected between the inner bump 26 and the outer bump 13.

In order to facilitate the rotation of the inner frame assembly 20 relative to the housing 11, in the technical solution, the lower end of the outer side plate 5 is connected to the outer bump 13; preferably, the outer bump 13 is connected to an inner side surface of the outer side plate 5; the inner side plate 24 and the outer side plate 5 are provided with a gap therebetween; the front end of the outer bump 13 extends inward; the front end of the inner bump 26 extends outward; the inner bump 26 and the outer bump 13 are respectively provided with coaxial shaft holes, and are connected via a bolt; the bolt is the front connecting shaft 27; in order to avoid the outer bump 13 and the inner bump 26 from contacting and generating a too large friction force during rotation, an isolation spacer is added between the inner bump 26 and the outer bump 13.

Further, the middle part of the inner side plate 24 extends upward to form a connecting sheet 8; the front middle part of the outer side plate 5 is connected to a mounting sheet 3; an air spring 4 is disposed between the mounting sheet 3 and the connecting sheet 8; and the two ends of the air spring 4 are respectively pivotally connected to the mounting sheet 3 and the connecting sheet 8.

In order to avoid the random rotation of the inner frame assembly 20 relative to the housing 11, the technical solution configures the air spring 4; preferably, when the air spring 4 is in an original state, the inner frame assembly 20 is in an inclined state.

Further, the rear end of the inner side plate 24 extends upward to form a pressing sheet 7; and an inclined upper limit sheet 1 is disposed at the upper end of the outer side plate 5. Preferably, the upper limit sheet 1 is connected to a flexible stopper.

The flexible stopper can adopt a rubber block and the like.

The pressing sheet 7 and the upper limit sheet 1 are configured to limit the rotation angle of the inner frame assembly 20; secondly, the flexible stopper can avoid rigid contact.

Preferably, the pressing sheet 7 is provided with a limit hole in the middle; the middle part of the upper limit sheet 1 is connected to a limit bar 2; and when the inner frame assembly 20 inclines until the pressing sheet presses against the upper limit sheet 1, the middle part of the limit bar 2 is located in the limit hole.

Figure 3:
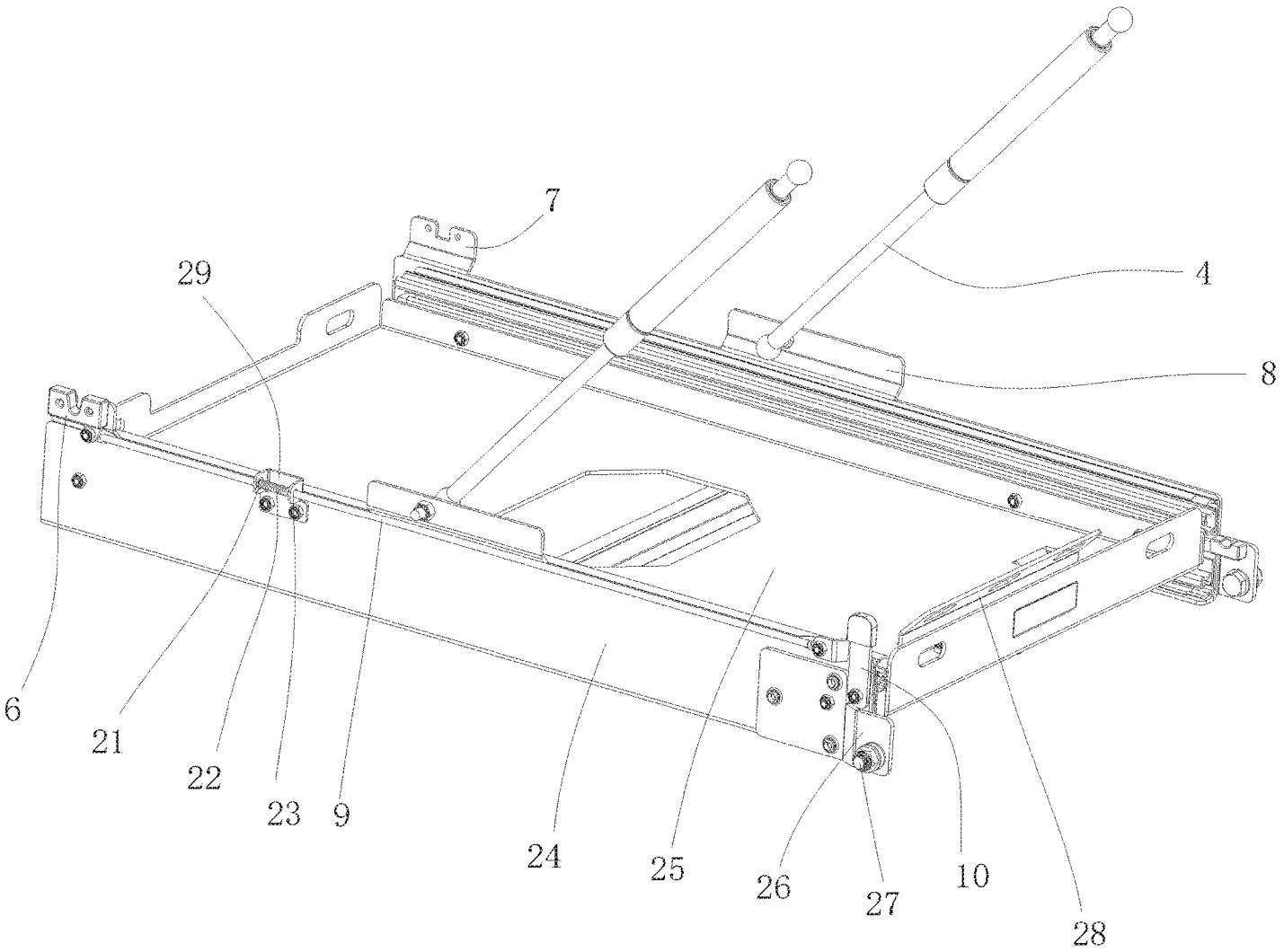
FIG. 3 is a structural schematic view of the present invention having the housing removed.

With reference to FIG. 3, preferably, one of the inner side plates is connected to a side lock assembly; the side lock assembly comprises a slide lock bar 10, an intermediate limit sheet 29, a transmission bar 9, a spring 22 and a lock block 6, wherein the lock block 6 is configured in a U-shape, and is fixed on one side of the pressing sheet 7; an extension block is disposed at the lower end of the lock block 6; the lower end of the side lock bar 10 is hingedly connected to the inner side plate 24; the middle part of the side lock bar 10 and the extension block are respectively hingedly connected to the two ends of the transmission bar 9; the intermediate limit sheet 29 is fixed at the inner side plate 24; the transmission bar 9 is provided with an annular fastening groove in the middle, and is connected to a reset sheet 21; the intermediate limit sheet 29 comprises at least one limit sheet 23; the limit sheet 23 is provided with a through hole in the middle; the transmission bar 9 penetrates through the through hole; the transmission bar 9 is sleeved on the spring 22; and the spring 22 is located between the reset sheet 21 and the limit sheet 23.

When the inner frame assembly 20 inclines, the limit bar 2 is located in the limit hole, and is also located in the lock block 6; the pressing sheet 7 is overhead, thus has a certain elasticity, and can generate a certain deformation; the side lock assembly is configured to lock the inner frame assembly 20 in an inclined state. For example, in the inclined state, the limit bar 2 is located in the middle of the lock block 6; the side lock bar 10 is such operated that the transmission bar 9 drives the lock block 6 to move forward; and the lock block 6 presses against the lock bar to generate a large friction force, so as to achieving the object of temporarily fixing the inner frame assembly 20.

Figure 2:
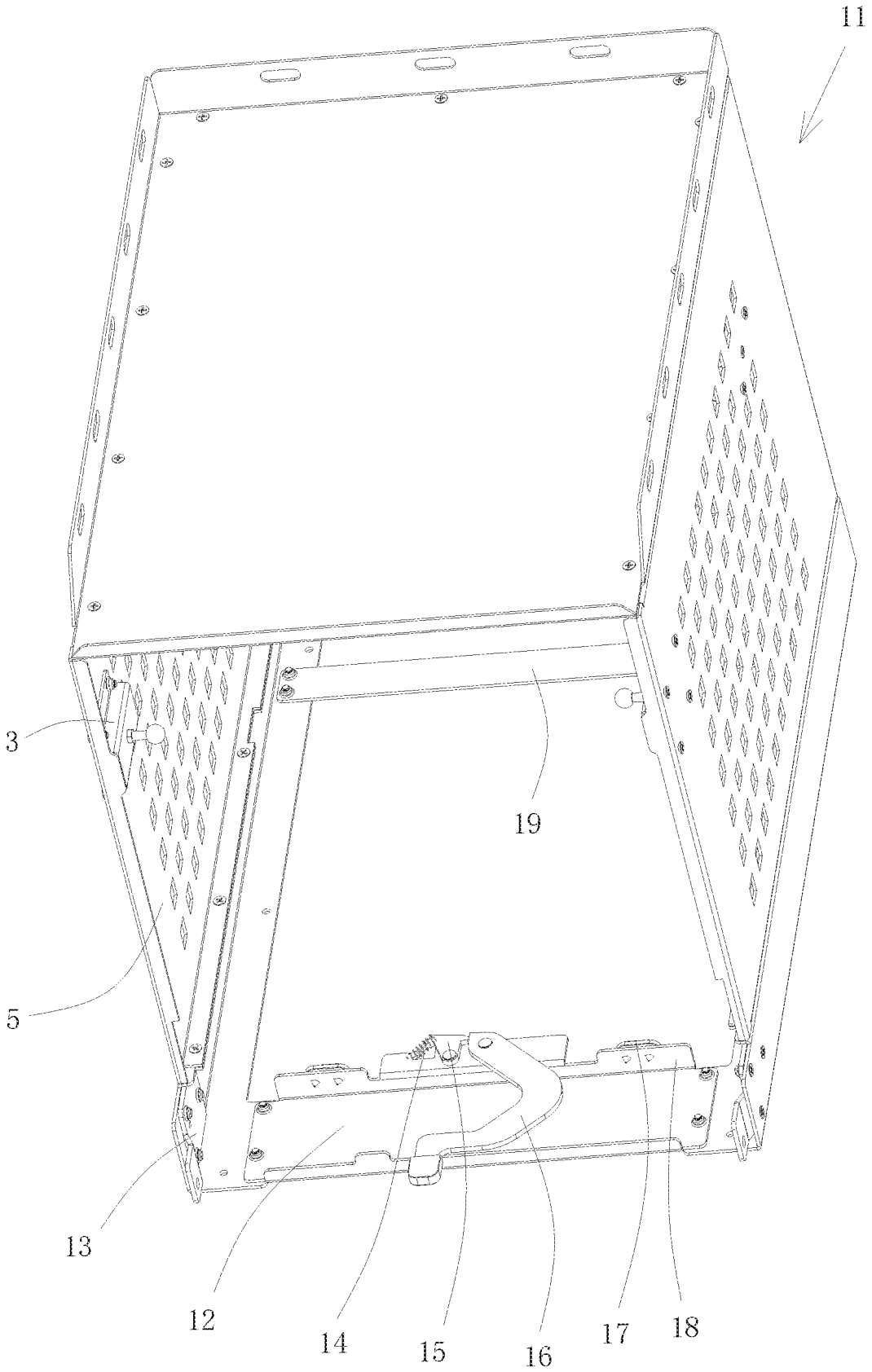
FIG. 2 is a structural schematic view of the housing of the present invention.

With reference to FIG. 2, further, the housing 11 is provided with a plurality of bottom transverse plates 19 at the bottom; the two ends of the bottom transverse plates 19 are respectively connected to the lower ends of two outer side plates; the bottom transverse plate 19 in frontmost is a front bottom plate 12; the front bottom plate 12 is connected to a front lock assembly; the front lock assembly comprises an arc-shaped lock sheet 16; the rear end of the lock sheet 16 is hingedly connected to the front bottom plate 12; the front end of the lock sheet 16 extends out of the front bottom plate 12; the front end of the tray assembly 35 extends downward to form a limit post 31; and the lower end of the limit post 31 is located in an inner space of the lock sheet 16.

In a specific configuration, the lower end of the outer side plate 5 is also configured in an L-shape, so as to facilitate the connection of the bottom transverse plates 19; the front lock assembly is configured to fix the tray assembly 35 after the goods or refrigerator are/or mounted, so as to prevent the tray assembly 35 from sliding relative to the inner frame assembly 20. When the tray assembly 35 slides into the inner frame assembly 20, the limit post 31 is located in the lock sheet 16; that is, the forward movement track of the limit post 31 is blocked. If the tray assembly 35 needs to be moved out, then the lock sheet 16 would be rotated to leave the movement track of the limit post 31.

Preferably, the front bottom plate 12 is connected to an elastic unit for pushing the middle part of the lock sheet 16 to approach the limit post 31; after the provision of the elastic unit, the situation that the tray assembly 35 may move out due to the deviation of the lock sheet 16 from the movement track of the limit post 31 at ordinary times can be avoided.

Further, the elastic unit comprises a rotary sheet 15 and a reset spring 14; the rotary sheet 15 is hingedly connected to the front bottom plate 12; one end of the rotary sheet 15 presses against the rear end of the lock sheet 16; the front bottom plate 12 is provided with a pressing head; the reset spring 14 is located between the pressing head and the other end of the rotary sheet 15; the reset spring 14 pushes the rotary sheet 15 to rotate; and one end of the rotary sheet 15 pushes the lock sheet 16 to rotate to approach the limit post 31.

The elastic unit can also adopt a torsion spring; the torsion spring is disposed between the lock sheet 16 and the front bottom plate 12, and drives the lock sheet 16 to rotate. In the technical solution, the rotary sheet 15 acts as an intermediate transmission, therefore, no selection sheet is required. Instead, the reset spring 14 directly presses against one end of the lock sheet 16, and pushes the lock sheet 16 to rotate. The elastic unit controls the rotation of the lock sheet 16; and the lock sheet 16 is remained to lock the limit post 31, thus facilitating use.

Further, the slide assembly comprises a linear slide rail 33.

The slide assembly is configured to be the linear slide rail 33 having a simple structure in the prior art, for example, the linear slide rail 33 on a drawer.

Figure 4:
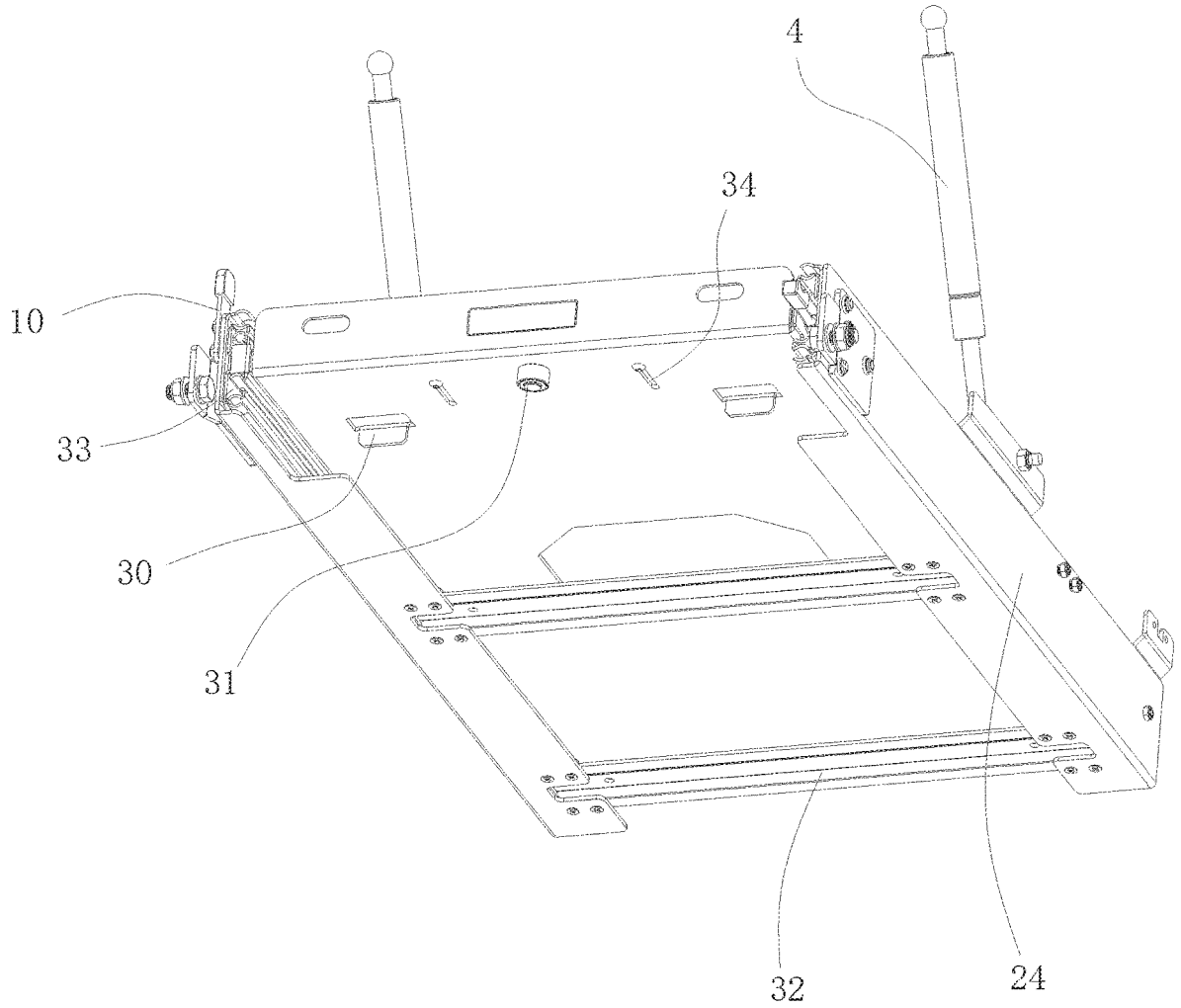
FIG. 4 is a structural schematic view of FIG. 3 from another visual angle.
Figure 5:
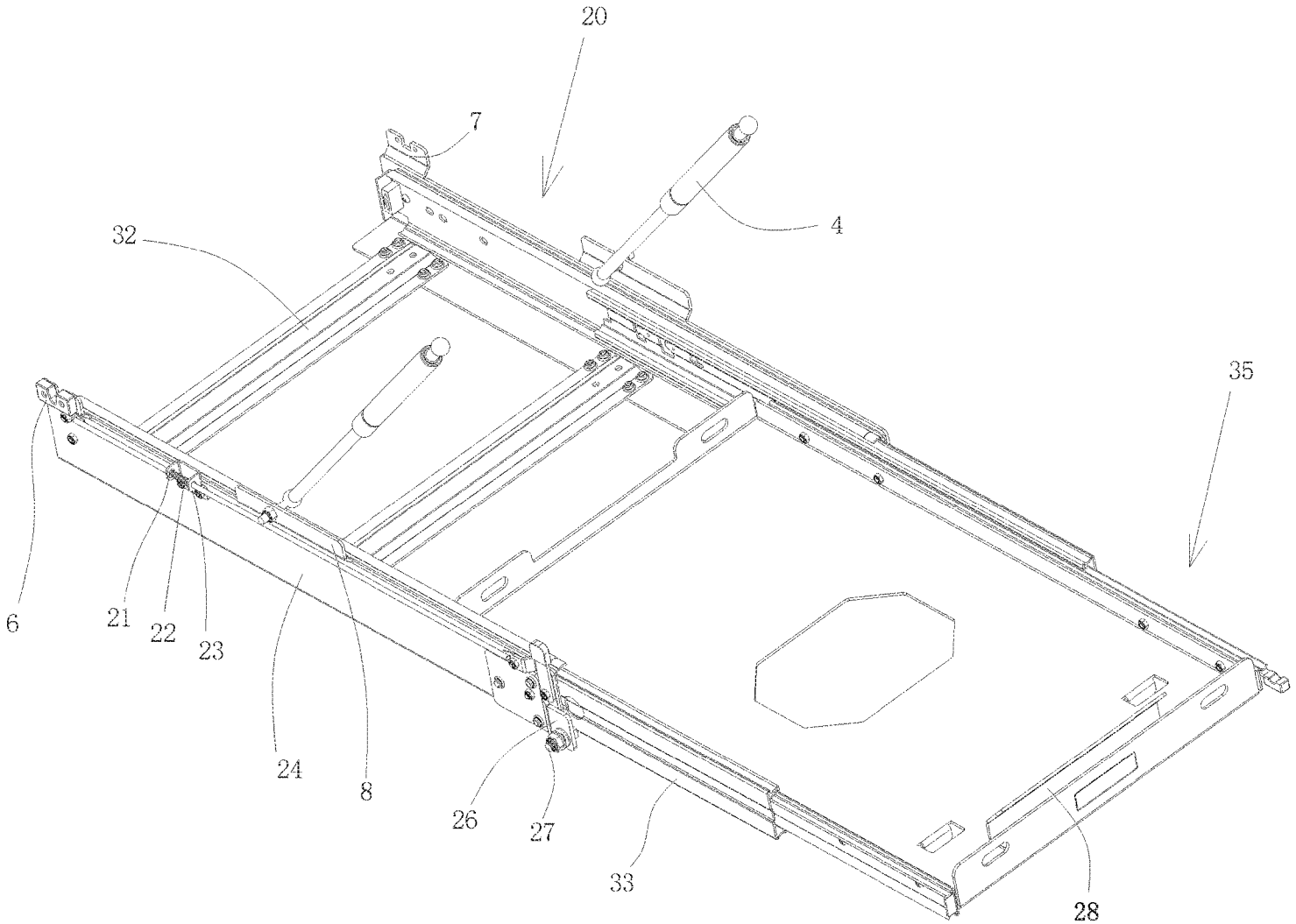
FIG. 5 is a structural schematic view of the expanded FIG. 3.

With reference to FIGS. 3-5, further, the tray assembly 35 comprises a tray 25; the slide assembly is disposed on the two sides of the tray 25; an inner lock plate 28 is disposed at the front end of the tray 25; the tray 25 is provided with a mounting groove 34; a connecting hole is disposed at the lower end of the inner lock plate 28; and the connecting hole is connected to the mounting groove 34 via a connector.

The inner lock plate 28 is configured to fix the goods or the refrigerator; when the inner lock plate 28 is connected to the tray 25, the position thereof is adjustable, thus facilitating use.

With reference to FIG. 2, further, a front stopper 18 is disposed at the rear end of the front bottom plate 12; the front stopper 18 is connected to a buffer 17; and the tray 25 is provided with a blocking sheet 30 matched with the front stopper 18.

When the tray assembly 35 slides relative to the inner frame assembly 20, the sliding of the tray assembly 35 needs to be limited; in the technical solution, the front stopper 18 and the blocking sheet 30 are such configured that when the tray assembly 35 moves to the inner frame assembly 20, the tray assembly 35 would not stop until the blocking sheet 30 presses against the buffer 17.

The above embodiments are preferred implementation solutions of the present invention. Besides, the present invention can also be implemented in other ways, and any obvious substitutions without departing from the concept of the present invention are all concluded in the protection scope of the present application.

What is claimed is:

1. An integrated inclinable goods shelf, comprises:

a housing, an inner frame assembly, and a tray assembly, configured to bear goods;

wherein a front side of the housing has an opening; the inner frame assembly is lapped on a bottom surface of the housing; the housing comprises two outer side plates; the inner frame assembly comprises two inner side plates; the two inner side plates are respectively disposed between a first outer side plate of the two outer side plates and the tray assembly and between a second outer side plate of the two outer side plates and the tray assembly; a front end of the first outer side plate of the two outer side plates is hingedly connected to a front end of the first inner side plate, and a front end of the second outer side plate of the two outer side plates is hingedly connected to a front end of the second inner side plate; the inner frame assembly rotates relative to the housing; the two inner side plates are connected to the tray assembly via a slide assembly; and the tray assembly moves relative to the inner frame assembly;

a middle part of each of the two inner side plates extends upward to form a connecting sheet; a front middle part of each of the two outer side plates is connected to a mounting sheet; an air spring is disposed between the mounting sheet and the connecting sheet; and two ends of the air spring are pivotally connected to the mounting sheet and the connecting sheet, respectively.

2. The integrated inclinable goods shelf of claim 1, wherein, a lower end of each of the two outer side plates extends forward or is connected to an outer bump; each of the two inner side plates is connected to an inner bump extending forward; and a front connecting shaft is connected between the inner bump and the outer bump.

3. The integrated inclinable goods shelf of claim 1, wherein, a pressing sheet is formed by extending a rear end of the first inner side plate extends upwardly; and an inclined upper limit sheet is disposed at an upper end of each of the two outer side plates.

4. The integrated inclinable goods shelf of claim 3, wherein, a middle of the pressing sheet is provided with a limit hole; a middle part of the inclined upper limit sheet is connected to a limit bar; and when the inner frame assembly inclines until the pressing sheet presses against the inclined upper limit sheet, a middle part of the limit bar is located in the limit hole.

5. The integrated inclinable goods shelf of claim 1, wherein, the second inner side plate is connected to a side lock assembly; the side lock assembly comprises a slide lock bar, an intermediate limit sheet, a transmission bar, a spring and a lock block; the lock block is U-shaped and is fixed on one side of a pressing sheet; an extension block is disposed at a lower end of the lock block; a lower end of the side lock bar is hingedly connected to the second inner side plate; a middle part of the side lock bar and the extension block are hingedly connected to two ends of the transmission bar, respectively; the intermediate limit sheet is fixed at the second inner side plate; a middle of the transmission bar is provided with an annular fastening groove and is connected to a reset sheet; the intermediate limit sheet comprises at least one limit sheet; a middle of the at least one limit sheet is provided with a through hole; the transmission bar penetrates through the through hole; the transmission bar is sleeved on the spring; and the spring is located between the reset sheet and the at least one limit sheet.

6. The integrated inclinable goods shelf of claim 1, wherein, a bottom of the housing is provided with a plurality of bottom transverse plates; two ends of each of the plurality of bottom transverse plates are respectively connected to a lower end of the first outer side plate and a lower end of the second outer side plate; a bottom transverse plate of the plurality of bottom transverse plates on a most front side of the bottom of the housing is a front bottom plate; the front bottom plate is connected to a front lock assembly; the front lock assembly comprises an arc-shaped lock sheet; a rear end of the arc-shaped lock sheet is hingedly connected to the front bottom plate; a front end of the arc-shaped lock sheet extends out of the front bottom plate; a front end of the tray assembly extends downward to form a limit post; and a lower end of the limit post is located in an inner space of the arc-shaped lock sheet.

7. The integrated inclinable goods shelf of claim 6, wherein, the front bottom plate is connected to an elastic unit configured to push a middle part of the arc-shaped lock sheet to approach the limit post; and the elastic unit is configured to prevent the tray assembly from moving out due to a deviation of the arc-shaped lock sheet from a movement track of the limit post.

8. The integrated inclinable goods shelf of claim 6, wherein, the elastic unit comprises a rotary sheet and a reset spring; the rotary sheet is hingedly connected to the front bottom plate; a first end of the rotary sheet presses against the rear end of the arc-shaped lock sheet; the front bottom plate is provided a pressing head; the reset spring is located between the pressing head and a second end of the rotary sheet; the reset spring pushes the rotary sheet to rotate; and the first end of the rotary sheet pushes the arc-shaped lock sheet to rotate and approach the limit post.

9. The integrated inclinable goods shelf of claim 1, wherein, the tray assembly comprises a tray; the slide assembly is disposed on two sides of the tray; an inner lock plate is disposed at a front end of the tray; the tray is provided with a mounting groove; a front stopper is disposed at a rear end of a front bottom plate; the front stopper is connected to a buffer; and the tray is provided with a blocking sheet matched with the front stopper.

* * * * *